US009422841B2

(12) United States Patent
Goldstein

(10) Patent No.: US 9,422,841 B2
(45) Date of Patent: Aug. 23, 2016

(54) FILL TUBE WITH POP-UP POURING ASSISTANCE ASSEMBLY

(71) Applicant: Group One Limited, Ramsey (GB)

(72) Inventor: Fredric Goldstein, Nacka (SE)

(73) Assignee: GROUP ONE LIMITED, Ramsey, British Isles (IM)

( * ) Notice: Subject to any disclaimer, the term of this patent is extended or adjusted under 35 U.S.C. 154(b) by 0 days.

(21) Appl. No.: 14/378,671

(22) PCT Filed: Feb. 15, 2013

(86) PCT No.: PCT/US2013/026371

§ 371 (c)(1),
(2) Date: Aug. 14, 2014

(87) PCT Pub. No.: WO2013/123345

PCT Pub. Date: Aug. 22, 2013

(65) Prior Publication Data

US 2015/0027584 A1 Jan. 29, 2015

Related U.S. Application Data

(60) Provisional application No. 61/599,006, filed on Feb. 15, 2012.

(51) Int. Cl.

| | |
|---|---|
| ***B65B 39/00*** | (2006.01) |
| ***F01M 11/04*** | (2006.01) |
| *B67C 11/00* | (2006.01) |

(52) U.S. Cl.

CPC ..... *F01M 11/0458* (2013.01); *F01M 11/04* (2013.01); *B67C 2011/20* (2013.01); *F01M 2011/0491* (2013.01)

(58) Field of Classification Search

CPC ... B67C 11/02; B67C 2011/20; F01M 11/04; F01M 11/0458; F01M 2011/0491

USPC ..... 141/333, 337, 338, 363–366

See application file for complete search history.

(56) References Cited

U.S. PATENT DOCUMENTS

| | | | | |
|---|---|---|---|---|
| 1,242,453 | A | 10/1917 | Lester | |
| 1,420,011 | A | 6/1922 | Abbott | |
| 1,420,039 | A * | 6/1922 | Horstkotte | B67C 11/02 141/338 |
| 1,461,654 | A | 7/1923 | Haessler | |
| 1,510,631 | A | 10/1924 | Nutry | |
| 1,740,418 | A | 12/1929 | Donnelly | |
| 2,040,356 | A * | 5/1936 | Butcher | F16K 15/202 137/111 |
| 5,241,753 | A | 9/1993 | Lalevee, Sr. | |
| 5,386,881 | A * | 2/1995 | Eshelman | F01M 11/04 141/98 |
| D403,642 | S | 1/1999 | Acord | |
| 5,857,504 | A | 1/1999 | Tremblay | |
| 5,894,872 | A * | 4/1999 | Gale | B62J 35/00 141/338 |
| 6,397,907 | B1 | 6/2002 | Heintz | |
| 6,837,283 | B1 * | 1/2005 | Wegner | B65B 39/02 141/338 |

(Continued)

*Primary Examiner* — Jason K Niesz

(74) *Attorney, Agent, or Firm* — Carlson, Gaskey & Olds P.C.

(57) ABSTRACT

An assembly for assisting with the pouring of fluid includes, among other aspects, a fill tube and a pop-up component disposed at least partially within the fill tube. The pop-up component assists with directing poured fluid into the fill tube.

16 Claims, 5 Drawing Sheets

(56) References Cited

U.S. PATENT DOCUMENTS

| | | | |
|---|---|---|---|
| 6,935,389 | B1 | 8/2005 | Rinaldi |
| 7,014,074 | B1 | 3/2006 | Rinaldi |
| 7,264,027 | B2 | 9/2007 | Rosenbaum |
| 7,886,782 | B1 | 2/2011 | Curtis |
| 2006/0185763 | A1 | 8/2006 | Rosenbaum |
| 2012/0103466 | A1* | 5/2012 | Castillo ..... B67C 11/02 141/338 |

* cited by examiner

FILL TUBE WITH POP-UP POURING ASSISTANCE ASSEMBLY

BACKGROUND

This disclosure relates to a fill tube with a pop-up pouring assistance feature.

Fluids poured from a container exit the container along different paths depending upon the angle of the container, the diameter of the opening, the amount of fluid in the container, the speed in which the container is tipped, etc. Pouring a fluid directly into the fill tube during the entire action of pouring requires a high degree of skill.

In the automotive industry, funnels are primarily used to assist the pouring of fluid into various parts of an automobile engine. When a user fills an engine with oil, for example, in order to avoid spilling oil, the user situates a funnel relative to the oil fill tube, supporting the funnel with one hand, and then directs fluid from a bottle toward the funnel with the other hand. While these separate funnels are typically used in the automotive industry, there are known systems that directly incorporate a funnel into a fill tube.

SUMMARY

Disclosed is an assembly for assisting with the pouring of a fluid, including a fill tube having an axial fill tube opening on an axial end, wherein the fill tube is operable to guide fluid from the axial fill tube opening to a reservoir, and a pop-up tube disposed at least partially in the fill tube, wherein the pop up tube is axially movable relative to the fill tube, and wherein the pop-up tube includes an axial pop up tube opening operable to guide fluid from the axial pop up tube opening to the axial fill tube opening.

Also disclosed is an assembly for assisting with the pouring of a fluid, including a fill tube having an axial fill tube opening on an axial end, wherein the fill tube is operable to guide fluid from the axial fill tube opening to a reservoir, and a pop-up chute disposed partially within the fill tube when the pop-up chute is in a first position and disposed fully within the fill tube when the pop-up chute is in a second position, wherein the pop-up chute is operable to move axially between the first position and the second position relative to the fill tube.

Also disclosed is a method of pouring fluid including the steps of exposing an opening in an outer tube, extracting an inner tube from said opening in said outer tube, pouring fluid into an opening provided by said inner tube, inserting said inner tube back into said outer tube, and closing said opening in said outer tube.

These and other features of the present disclosure can be best understood from the following drawings and detailed description.

BRIEF DESCRIPTION OF THE DRAWINGS

The drawings can be briefly described as follows.

DETAILED DESCRIPTION

Figure 1A:
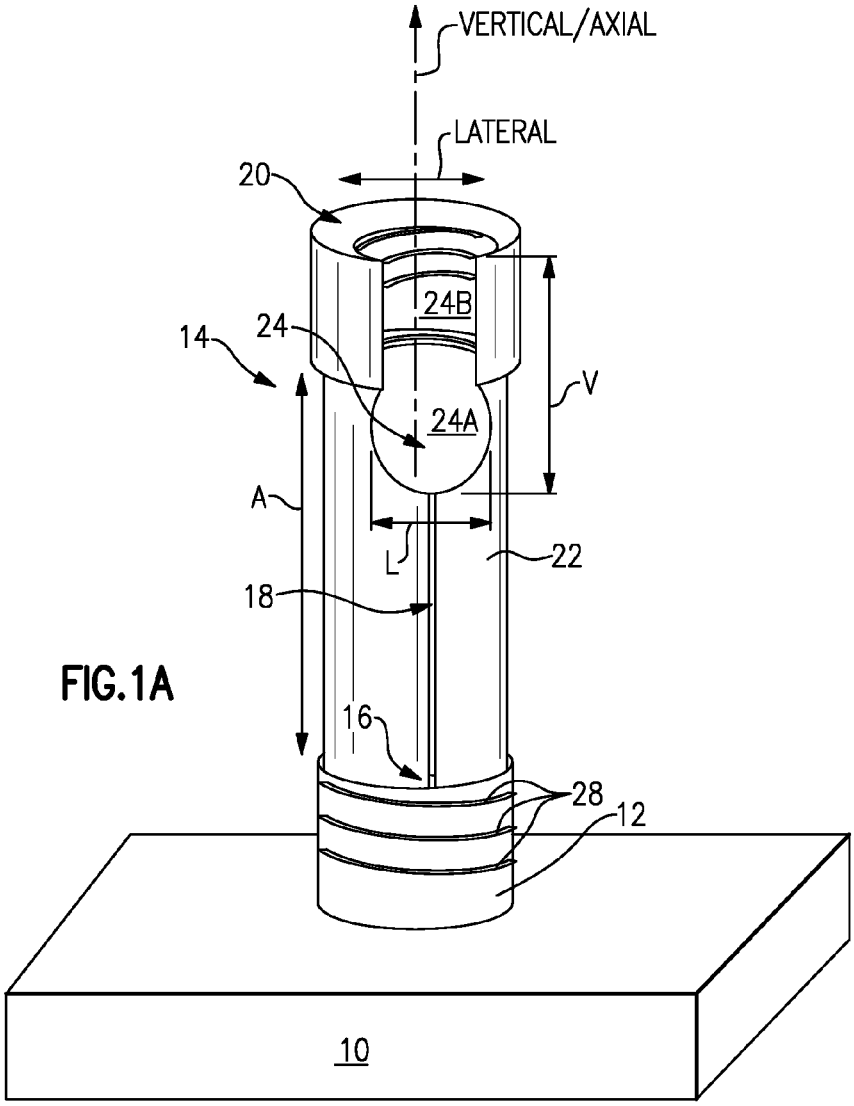
FIGS. 1A-1D illustrate a first embodiment of the disclosed pouring assistance assembly.

In a first embodiment of this disclosure, illustrated across FIGS. 1A-1D, a fluid reservoir (an engine block 10) is filled by pouring a fluid down a fill tube 12. To assist in this filling process, a pop-up pipe 14 (alternately referred to as a pop-up tube) is positioned such that it can move axially in a direction A relative to the fill tube 12. The pop-up pipe 14 of the example of FIGS. 1A-1D is arranged on the inside of the fill tube 12. Alternately, the pop pipe 14 can be arranged on the outside of the fill tube 12. Further, in the example of FIGS. 1A-1D, the pop-up pipe 14 is generally cylindrical, including a substantially constant diameter along its length.

The pop-up pipe 14 is configured to move in the direction A relative to the fill tube 12 by way of a tongue 16 and groove 18. This tongue-and-groove arrangement provides alignment during axial movement between the pop-up pipe 14 and the fill tube 12, and prevents any rotation of the main body 22 of the pop-up pipe 14 relative to the fill tube 12. The tongue-and-groove arrangement ensures that the pop-up pipe 14 will be aligned with the cap 20 so that an opening 24 will be formed, as well as consistently ensuring the most convenient orientation for that opening 24, such that the opening 24 is amenable to pouring fluid. Alternate examples omit the tongue-and-groove arrangement.

A cap 20 is located at an upper axial end of the pop-up pipe 14. The cap 20 is rotatable relative to a main body 22 of the pop-up pipe 14. The cap 20 is rotatable to axially cover and/or reveal an opening 24 provided by the pop-up pipe 14 and the cap 20. In the illustrated example, the opening 24 includes cut-outs 24A, 24B in the pop-up pipe 14 and the cap 20, respectively.

Figure 1B:
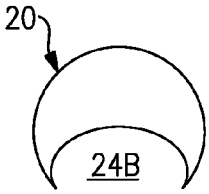
Figure 1C:
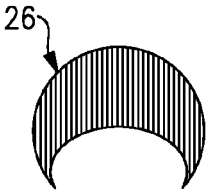
Figure 1D:
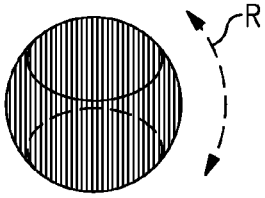

In one example, the cap 20 is generally crescent shaped when viewed axially (from above), as in FIG. 1B. Likewise, in one example, the top of the pop-up pipe 14 is similarly shaped, as represented by element 26 in FIG. 1C. Depending on whether one wishes to conceal or reveal the opening 24 in the pop-up pipe 14, the cap 20 can be rotated relative to the top 26 of the pop-up pipe 14, in a direction R, as illustrated in FIG. 1D.

The pop-up pipe 14 is configured to move telescopically relative to the fill tube 12. If a user desires to add fluid into the reservoir 10, the pop-up pipe 14 is extracted from the fill tube 12 as illustrated in FIG. 1A, and the cap 20 is rotated relative to the top 26 of the pop-up pipe 14 to reveal the opening 24. This provides an opening 24 with substantial vertical and lateral dimensions V, L for nearly any pouring job. In some examples, the pop-up pipe 14 can lock relative to the fill tube 12 in this extracted, or upright, position.

With the combined openings from the cut-outs 24A, 24B, a neck of a bottle can be inserted into the opening 24 and, when tipped horizontally, the neck is already securely positioned inside the pop-up pipe 14. Fluid thus cannot spill out due to an unpredictable path of its exit. Further, in some examples, when with the neck of a bottle inserted into the opening 24, and the bottle is tipped upright, no additional support from the user is needed while the fluid drains out of the bottle.

Figure 4:
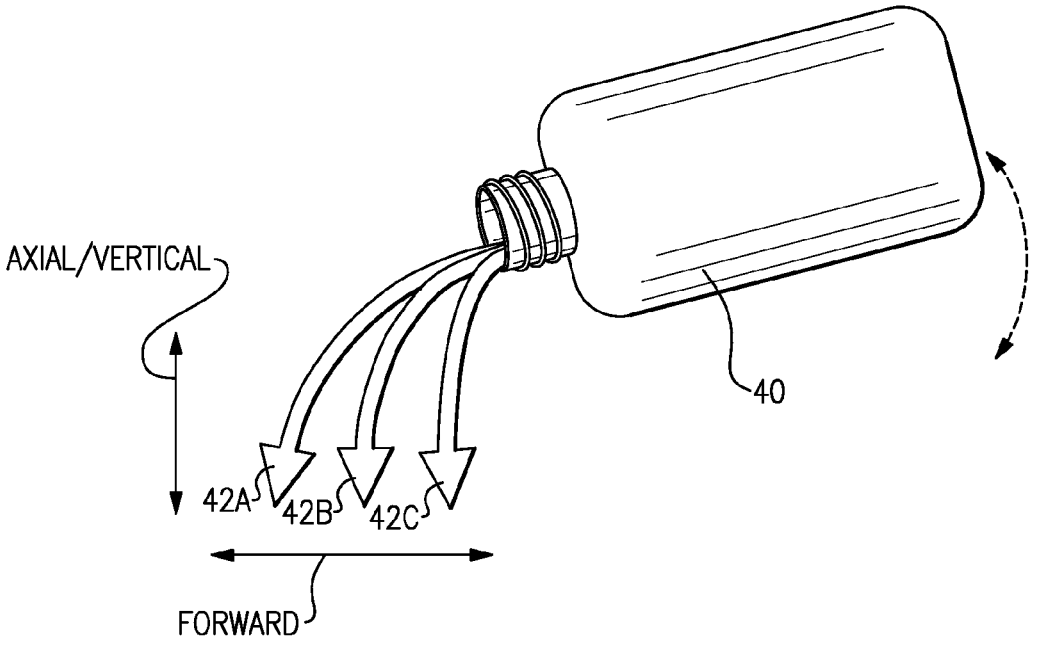
FIG. 4 illustrates a bottle and various example fluid exit paths.

While the illustrated example of FIGS. 1A-1D, includes a lateral dimension L that is smaller than a vertical dimension V, a user can be relied on to laterally align a bottle containing a fluid with the opening 24, or to insert the neck of the fluid container directly through the opening 24 into the fill pipe. Then, the larger vertical dimension V of the opening 24 sufficiently accommodates the various fluid paths, or arcs, once the bottle is tipped and/or inserted. That is, users are often surprised by the initial velocity of a fluid once a pouring action is initiated, whereas fluids rarely—if ever—take unexpected lateral paths from a bottle. For example, see FIG. 4, which schematically represents a bottle, or fluid container, 40 and a number of arcs 42A-42C, which, depend on tilt angle, the diameter of an opening of the bottle, the amount of fluid in the container, the speed in which the container is tipped, etc.

After pouring is complete, to store the pop-up pipe 14, the pop-up pipe 14 is moved axially down (e.g., in the example of FIGS. 1A-1D, guided by way of the tongue and groove connection 16, 18) and the cap 20 can be screwed onto the fill tube 12 by way of optional threads 28. When screwing the cap 20 onto the threads 28, the cap 20 and threads 28 are configured so as to axially cover the opening 24 to prevent entry of unwanted debris into the fill tube 12 (as illustrated in FIG. 1D). The remainder of the opening 24, specifically the cut-out 24A in the pop-up pipe 14, is covered by the fill tube 12.

Notably, the cap 20 is completely removable from the pop-up pipe 14 in one example, or optionally configured to remain coupled to the pop-up pipe 14 while still being rotatable relative to the pop-up pipe 14 in an alternate example. In the latter case, the cap 20 is prevented from being misplaced.

Figure 2:
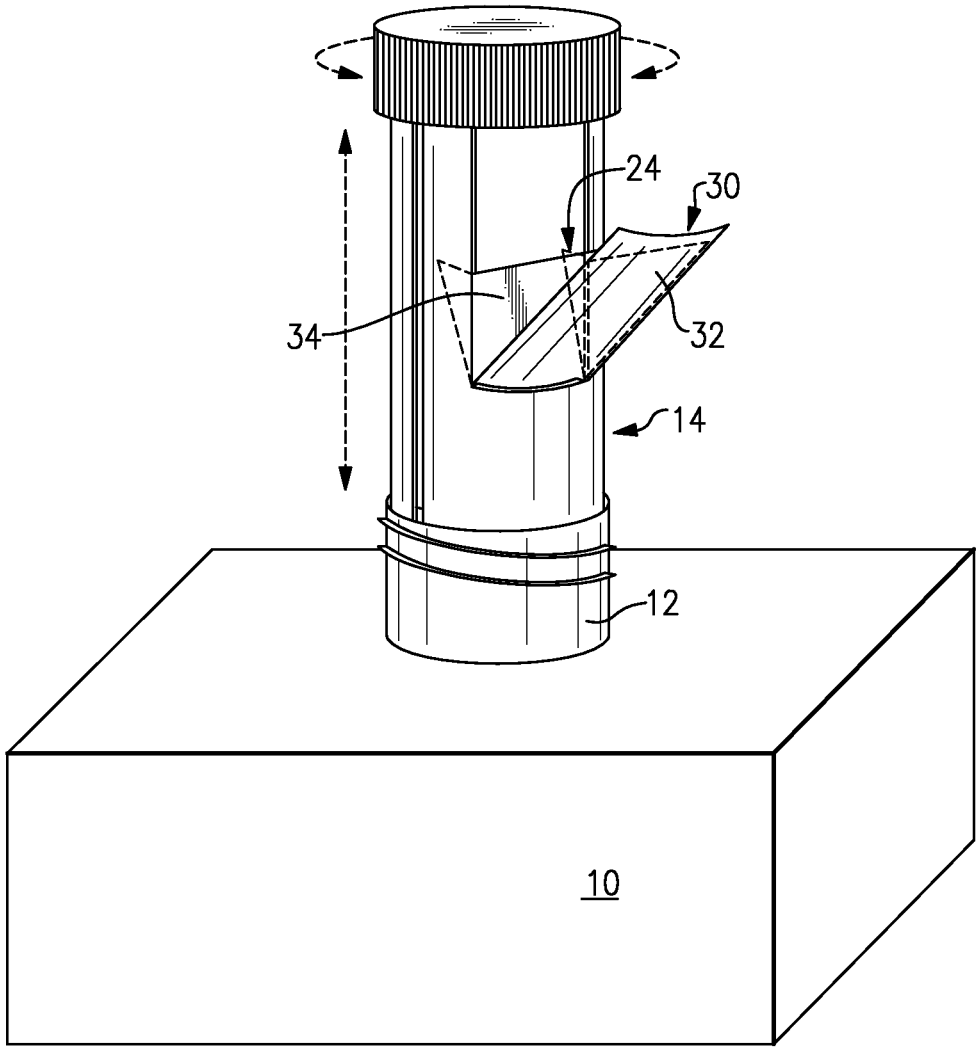
FIG. 2 illustrates a second embodiment of the disclosed pouring assistance assembly.

FIG. 2 illustrates another embodiment in which the opening 24 of the pop-up tube 14 is accompanied by a chute 30. The chute 30 includes a ramp portion 32, as well as optional sidewalls 34 to direct fluid poured from a bottle into the pop-up tube 14. In the illustrated example the chute 30 is spring loaded, and biased away from the pop-up pipe 14 toward the outward position generally shown in FIG. 2. Alternately the chute 30 is positioned such that it naturally falls to the outward position of FIG. 2 due to gravity. When returning the pop-up tube 14 into the fill tube 12, the chute 30 retracts to an upright position by engaging the ramp portion 32 with the fill tube 12. In one example, fill tube 12 comprises an enabling structure to guide the chute 30 into the closed position upon its impact with fill tube 12. In an alternative example, the chute 30 is manually retractable and re-insertable.

Figure 3A:
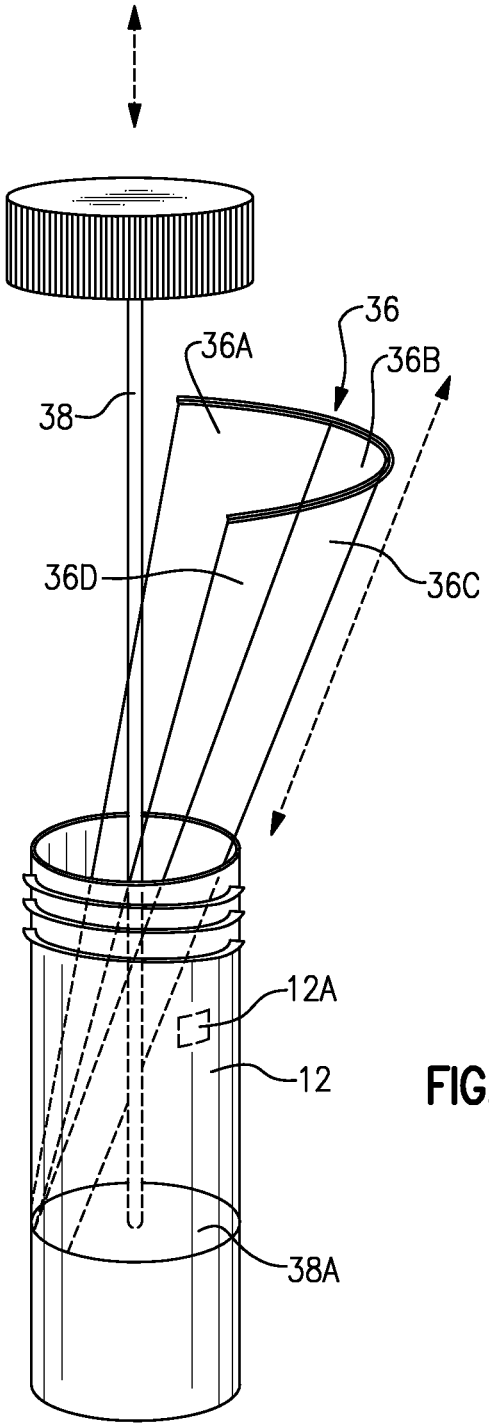
FIGS. 3A-3B illustrates a third embodiment of the disclosed pouring assistance assembly.
Figure 3B:
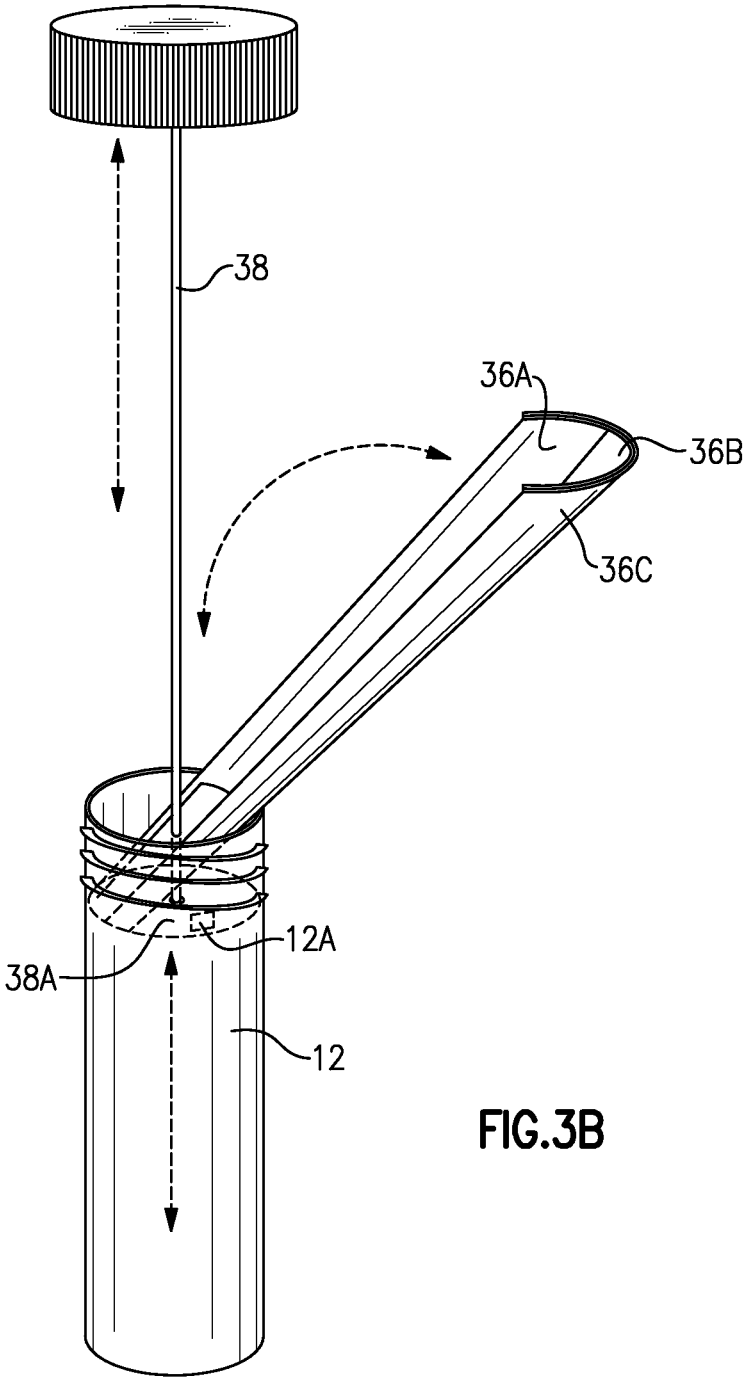

In a third embodiment, illustrated in FIGS. 3A-3B, a chute 36, similar in function to the chute 32 of FIG. 2, is disclosed without the associated pop-up pipe 14 of the first two embodiments. Instead, the chute 36 includes one or more layered, semi-circular elements 36A-36D configured to move axially in and out of the fill tube 12 by way of connection to a stick 38, and associated cap. Due to the length of the elements 36A-36C, when the chute 36 is extracted from the fill tube 12, the elements 36A-36D naturally fall outward, away from the stick 38, as illustrated in FIG. 3B, to a position amenable to guiding the fluid into the fill tube 12. Extraction of the stick 38 from the fill tube 12 may be limited by axial stoppers 12A and 38A, which are arranged to provide the chute 36 at the angle illustrated in FIG. 3B. These axial stoppers 12A, 38A not only allow for consistency in positioning of the chute 36, but also allow a user to rest an inverted bottle against the chute 36 while fluid drains from the bottle into the fill tube 12, without the chute 36 being removed out of the fill tube 12.

If it is desired to avoiding moving parts, such as those commonly associated with an in-built funnel, the chute 36 can alternately be a solid chute 36, without the individually movable elements 36A-36C.

While traditional funnels define a complete frustoconical shape, the opening 24, as well as the chutes 30 and 36 described herein, allow for adequate pouring assistance, while perhaps only defining a semi-frustoconical shape. That is, the opening 24 and the chutes 30, 36 have a vertical dimension (e.g., the length of the chutes) larger than a lateral dimension (e.g., the width of the chutes).

Again, a user is often surprised by the arc (e.g., distance, or velocity) that a fluid initially takes when projecting from a bottle upon pouring. See, again, FIG. 4 which shows a number of vertical exit arcs 42A-42C that a fluid may take upon exit from a bottle 40. Not only during initial pouring, but a target point of a fluid may change throughout a pour. For example, if arc 42A represents an initial arc, the initial arc would move toward arc 42C as fluid was drained from the bottle 40. This requires constant adjustment of the tilt angle of the bottle 40, and increases the chances of spilling. Accordingly, the disclosed openings are focused toward accounting for this unpredictable factor in pouring, while relying on the reasonable judgment of a user to account for the lateral fluid direction, which typically remains predictable and constant.

The ability of the disclosed embodiments to "pop-up" relative to the fill tube also provides a user with increased control over alignment during the initial pouring of fluid. That is, a user can align the neck of bottle with the opening without needing to overly tip the bottle, which could cause fluid to be poured unintentionally. Notably, in examples such as FIG. 1, the user can insert the neck of a bottle directly into the opening 24 without tipping the bottle much—if at all—and thus concerns over unintended spilling are reduced, if not eliminated.

In this regard, the instant disclosure addresses the only real issue at hand (i.e., the vertical/forward arc of the fluid during pouring), whereas traditional frustoconical funnels unnecessarily also account for a lateral fluid direction, leading to wasted material and increased manufacturing costs.

While specific reference is made to the use of the disclosed assembly in the automotive field, other industries may benefit from this disclosure. In that regard, the disclosed fluid is not limited to automotive oil reservoirs.

Although the different examples have the specific components shown in the illustrations, embodiments of this invention are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. An assembly for assisting with the pouring of a fluid, comprising:

a fill tube including an axial fill tube opening on an axial end, wherein said fill tube is operable to guide fluid from said axial fill tube opening to a reservoir;

a pop-up tube disposed at least partially in said fill tube, wherein said pop-up tube is axially movable relative to said fill tube, and wherein said pop-up tube includes a pop-up tube opening operable to guide fluid from said pop-up tube opening to said axial fill tube opening, wherein said pop-up tube opening is provided only on one side of said pop-up tube; and a cap coupled to an axial end of said pop-up tube, said cap being rotatable relative to said pop-up tube, said cap remaining coupled to said pop-up tube as said pop-up tube axially moves relative to said fill tube.

2. The assembly as recited in claim 1, wherein said pop-up tube includes a chute positioned adjacent the opening therein to direct fluid from said chute into said pop-up tube.

3. The assembly as recited in claim 1, wherein said opening in said pop-up tube is operable to allow said fluid to exit a fluid container while a neck of said fluid container is positioned within said pop-up tube opening.

4. The assembly as recited in claim 1, wherein a threaded connection between said cap and sail fill tube seals said fill tube.

5. The assembly as recited in claim 1, wherein said pop-up tube further comprises one of a tongue and a groove, said fill tube comprises the other of said groove and said tongue, and said tongue is disposed within said groove, to prevent rotation of said pop-up tube relative to said fill tube.

6. An assembly for assisting with the pouring of a fluid, comprising:

a fill tube including an axial fill tube opening on an axial end, wherein said fill tube is operable to guide fluid from said axial fill tube opening to a reservoir;

a chute disposed at least partially outside said fill tube when said chute is in a first position and disposed fully within said fill tube when said chute is in a second position, wherein said chute falls to only one side of said fill tube when said chute is in said first position;

wherein said chute is operable to move axially between said first position and said second position relative to said fill tube;

a cap operable to cover said axial fill tube opening when said chute is in said second position, said cap connected to a stick insertable into said fill tube, said chute connected to said stick.

7. The assembly of claim 6, further comprising:

an axial stopper disposed within said fill tube and configured to limit extraction of said chute from said fill tube.

8. A method of pouring fluid comprising the steps of:

exposing an opening in a fill tube by rotating a cap;

partially extracting a pop-up tube from said opening in said fill tube, said cap being rotatable relative to said pop-up tube, said cap being coupled to an axial end of said pop-up tube and remaining coupled to said pop-up tube as said pop-up tube axially moves relative to said fill tube;

pouring fluid into an opening provided by said pop-up tube, wherein said opening provided by said pop-up tube is provided in only one side of said pop-up tube;

inserting said pop-up tube back into said fill tube; and closing said opening in said fill tube.

9. The method of claim 8, further comprising placing a neck of a fluid container in said opening in said pop-up tube, thereby allowing said pop-up tube to support said fluid container and allowing fluid to flow from said fluid container into said pop-up tube.

10. The method of claim 8, wherein said step of closing said opening in said fill tube further comprises screwing a cap disposed on said pop-up tube to said fill tube by interfacing threads on said cap with threads on said fill tube.

11. The assembly of claim 2, wherein said chute includes a ramp configured to fall to only one side of said pop-up tube as said pop-up tube moves axially relative to said fill tube.

12. The assembly of claim 2, wherein said chute is spring-loaded and biased away from said pop-up tube, said chute configured to project outwardly from only one side of said pop-up tube as said pop-up tube moves axially relative to said fill tube.

13. The assembly of claim 7, wherein said chute provides a semi-frustoconical shape.

14. The assembly of claim 13, wherein said chute is provided by a plurality of layered elements.

15. The assembly of claim 7, wherein said chute falls naturally under the force of gravity to only one side of said fill tube when said chute is in said first position.

16. The method as recited in claim 8, further comprising:

directing fluid being poured into said opening in said pop-up tube with a chute, said chute configured to fall to only one side of said pop-up tube as said pop-up tube is partially extracted from said fill tube.

* * * * *